US010096238B2

(12) United States Patent
Manning et al.

(10) Patent No.: US 10,096,238 B2
(45) Date of Patent: Oct. 9, 2018

(54) MULTIDIMENSIONAL INFORMATION GRAPHICAL USER INTERFACE FOR ENERGY SYSTEMS

(71) Applicant: GENERAL ELECTRIC TECHNOLOGY GMBH, Baden (CH)

(72) Inventors: Gregory Boyd Manning, Kirkland, WA (US); Gennaro Castelli, Bothell, WA (US); Michael Quinn Howard, Bothell, WA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 837 days.

(21) Appl. No.: 13/656,612

(22) Filed: Oct. 19, 2012

(65) Prior Publication Data

US 2014/0111351 A1 Apr. 24, 2014

(51) Int. Cl.
*G08C 23/04* (2006.01)

(52) U.S. Cl.
CPC ..... *G08C 23/04* (2013.01)

(58) Field of Classification Search
CPC .. G06Q 10/10; G06Q 10/0631; G06Q 10/087; G06Q 30/02; G06Q 40/06; G05B 19/409; G05B 2219/36133; G05B 2219/31438; G05B 2219/31439; G05B 2219/24103; G05B 2219/24123; G05B 23/0272
USPC ..... 340/870.01
See application file for complete search history.

(56) References Cited

U.S. PATENT DOCUMENTS

| | | | | |
|---|---|---|---|---|
| 5,295,062 | A * | 3/1994 | Fukushima | 700/83 |
| 6,219,046 | B1 * | 4/2001 | Thomas et al. | 715/708 |
| 6,492,901 | B1 * | 12/2002 | Ridolfo | 340/506 |
| 7,010,754 | B2 * | 3/2006 | Breuer | 715/776 |
| 7,072,450 | B1 * | 7/2006 | Pinard | 379/88.11 |
| 7,353,121 | B2 * | 4/2008 | Baraty | 702/61 |
| 2001/0011946 | A1 * | 8/2001 | Horon | G08B 25/14 340/525 |
| 2003/0206203 | A1 * | 11/2003 | Ly | 345/853 |
| 2006/0015818 | A1 * | 1/2006 | Chaudhri et al. | 715/779 |
| 2006/0031180 | A1 * | 2/2006 | Tamarkin et al. | 705/412 |
| 2006/0129497 | A1 * | 6/2006 | Baraty | 705/63 |

(Continued)

*Primary Examiner* — Nay Tun
(74) *Attorney, Agent, or Firm* — Amin, Turocy & Watson, LLP

(57) ABSTRACT

Aspects of interaction with multidimensional information for an energy system are disclosed. The use of multidimensional information in a graphical user interface can facilitate efficient communication of information related to energy systems. Energy system information can be classified. A multidimensional information interface can include a plurality of rows and a plurality of columns populated with tokens representing energy system information, based on the classification of the energy system information. The tokens can be selectable tokens such that selection of tokens can be related to accessing detailed information related to the token. In some embodiments, indicators, particularly visual indicators, can be employed to convey additional information, such as counts, selection status, sums of rows or columns, etc. Further, augmentation effects can be employed to facilitate access to an additional layer of information, such as freshness of a token, acknowledged tokens, etc.

20 Claims, 10 Drawing Sheets

(56) References Cited

U.S. PATENT DOCUMENTS

| | | | | |
|---|---|---|---|---|
| 2006/0253205 | A1* | 11/2006 | Gardiner | G06F 17/28 700/19 |
| 2008/0004723 | A1* | 1/2008 | Fax | G05B 19/4184 700/51 |
| 2009/0089709 | A1* | 4/2009 | Baier et al. | 715/817 |
| 2010/0066484 | A1* | 3/2010 | Hanwright et al. | 340/3.44 |
| 2013/0021355 | A1* | 1/2013 | Ramarao | G05B 23/0272 345/531 |

* cited by examiner

MULTIDIMENSIONAL INFORMATION GRAPHICAL USER INTERFACE FOR ENERGY SYSTEMS

TECHNICAL FIELD

The present application relates generally to energy systems, and more particularly, to multidimensional information handling for energy systems.

BACKGROUND

Traditional energy systems, e.g., oil, gas, or electrical energy distribution systems, can employ user interface systems to communicate information about the energy system to individuals involved in the operation of the energy system. Traditional energy system operators generally are slow to adopt new technology in favor of employing older systems and techniques that are viewed as reliable, trusted, and familiar. As such, traditional energy systems can employ somewhat antiquated technologies for information handling, e.g., a physical enunciator panel with discrete lamps and switches to communicate energy system information to operations personnel. As an example, an alarm enunciator panel can include large numbers of lamps and physical switches arranged to emulate the connectivity of an electrical transmission system. As such, when an alarm for a particular transmission line trips, the alarm can be quickly associated with the failing transmission line simply from the location of the alarm lamp on the enunciator panel.

These traditional enunciator panel characteristics, e.g., alarm lamps being placed in a 'schematic' layout, etc., have often been carried into computerized display versions of enunciator panels. As such, a more modern conventional user interface can emulate the older technology physical enunciator panel. This can facilitate reduced training costs by keeping the 'look and feel' of older physical systems in newer computerized display environments. Both the older physical enunciator panel and the newer computerized display 'enunciator panel' have deficiencies by enforcing old models.

The above-described deficiencies of traditional technologies are merely intended to provide an overview of some of the problems of conventional technologies, and are not intended to be exhaustive. Other problems with conventional technologies and corresponding benefits of the various non-limiting embodiments described herein may become further apparent upon review of the following description.

SUMMARY

The following presents a simplified summary of the disclosed subject matter in order to provide a basic understanding of some aspects of the disclosed subject matter. This summary is not an extensive overview of the subject disclosure. It is intended to neither identify key or critical elements of the subject disclosure nor delineate the scope of the disclosed subject matter. Its sole purpose is to present some concepts of the disclosed subject matter in a simplified form as a prelude to the more detailed description that is presented later.

One or more embodiments of the disclosed subject matter illustrate aspects of a multidimensional information graphical user interface for an energy system. A system, facilitating interaction with multidimensional information for an energy system, can include a display, a memory and a processor. The memory can store computer-executable instructions such that the processor can execute the instructions to at least receive energy system information. The processor can further execute instructions to display a token. The token can be representative of a subset of the energy system information. Displaying the token can be in accordance with a multidimensional information interface scheme.

In another non-limiting aspect, a method is disclosed that can facilitate interaction with multidimensional information for an energy system. The method can include receiving energy system information. The energy system information can be received by a system including at least one processor and a display. The method can further include classifying the received energy system information. The method can also include displaying a token representing a subset of the energy system information. Displaying the token can be according to a multidimensional information interface scheme. Further, displaying the token can be based on the classification of the energy system information.

A further embodiment of the disclosed subject matter can include a computer-readable storage medium having computer-executable instructions stored thereon that, in response to execution, cause a computing device including a processor and a display to perform operations to facilitate interaction with multidimensional information for an energy system. The instructions can include classifying energy system information. The instructions can further include displaying a token representative of a subset of the energy system information. Displaying the token can be in accordance with a multidimensional information interface scheme. Displaying the token can also be based on the classification of the energy system information.

To the accomplishment of the foregoing and related ends, the disclosed subject matter, then, comprises the features hereinafter fully described. The following description and the annexed drawings set forth in detail certain illustrative aspects of the disclosed subject matter. However, these aspects are indicative of but a few of the various ways in which the principles of the disclosed subject matter may be employed. Other aspects, advantages and novel features of the disclosed subject matter will become apparent from the following detailed description of the disclosed subject matter when considered in conjunction with the drawings.

DETAILED DESCRIPTION

Figure 1:
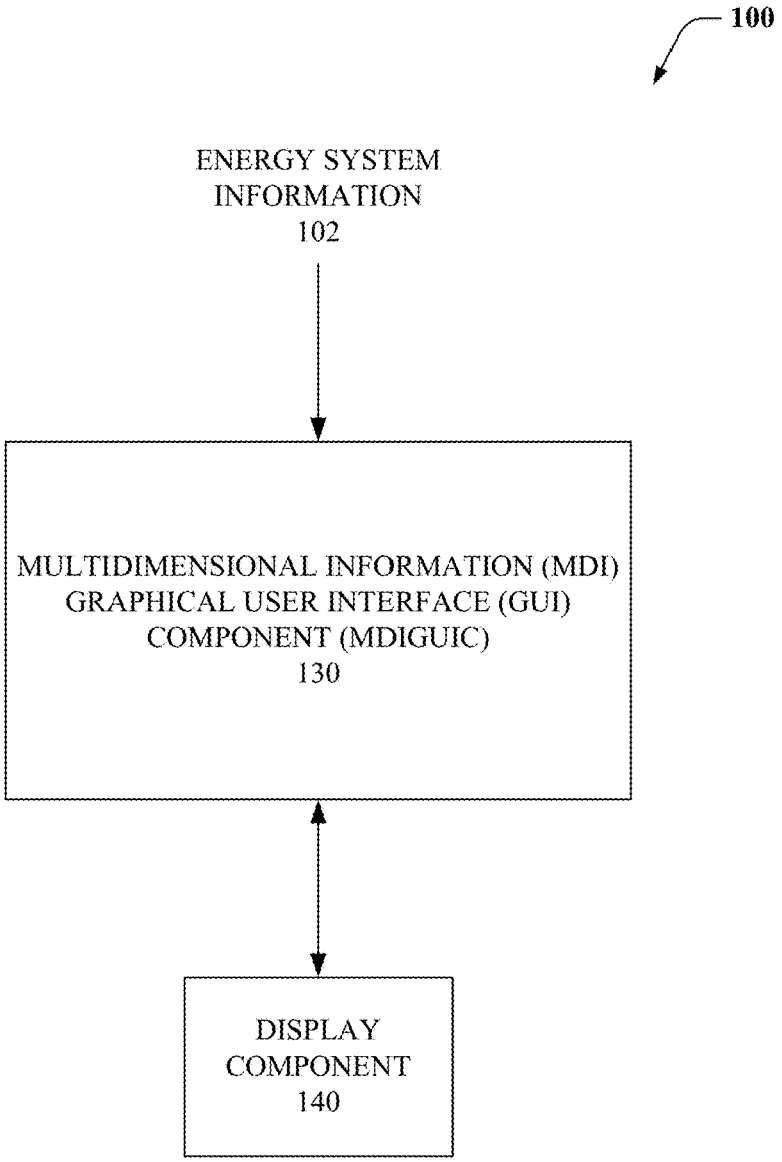
FIG. 1 illustrates a diagram of a system to facilitate interaction with multidimensional information for an energy system in accordance with aspects of the disclosed subject matter.

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It may be evident, however, that the disclosed subject matter may be practiced without these specific details. In other instances, well-known structures and devices are shown in block diagram form in order to facilitate describing the disclosed subject matter.

As mentioned, traditional energy systems, e.g., oil, gas, or electrical energy distribution systems, can employ user interface systems to communicate information about the energy system to individuals involved in the operation of the energy system. It will be noted, that for clarity and brevity, the following discussion can be described in terms of an electrical transmission system, though the disclosed subject matter is expressly not so limited and could just as easily be made in terms of an oil distribution system, a gas distribution system, or any other energy distribution system, all of which are considered within the scope of the present disclosure.

Despite improvements in information processing afforded by more modern computers, traditional energy system operators can generally be slow to adopt new technology in favor of employing older systems and techniques that are generally viewed as reliable, trusted, and familiar. As such, traditional energy systems can employ somewhat antiquated technologies for information handling. As an example, it would not be uncommon to encounter a physical enunciator panel with discrete lamps and switches in an electrical energy transmission system control room. Such a physical enunciator panel can be, for example, an alarm enunciator panel that can include large numbers of lamps and physical switches arranged to emulate the connectivity of an electrical transmission system. Alarms for elements of the electrical transmission system can be located to convey location information relative to the corresponding electrical transmission system element. As such, an alarm can be quickly associated with the element simply from the location of the alarm lamp on the physical enunciator panel.

Traditional enunciator panel characteristics can be embodied in computerized display versions of physical enunciator panels. As such, a more modern yet conventional user interface can actually emulate older technology physical enunciator panels, e.g., keeping the 'look and feel' of older physical systems in newer computerized display environments. However, both the older physical enunciator panel and the newer computerized display 'enunciator panel' fail to take advantage of data manipulation enabled by modern computer systems.

In contrast to these conventional information systems, a graphical user interface (GUI) can provide an environment that can capitalize on computer manipulation of energy system information. In an aspect, the presentation of information to users of control systems of an energy distribution system can be improved by beginning to depart from the simplistic presentation of information associated with conventional physical enunciator panels and their digitized siblings. Accordingly, energy system information can be aggregated, classified, and/or manipulated according to one or more rules, prior to presentation to control systems personnel. Classification of energy system information can facilitate user interaction with multidimensional information in the energy system GUI. As a non-limiting example, alarms can be classified by type and further classified by priority, such that an alarm matrix can be generated in a multidimensional information GUI for the energy system, e.g., rows for alarm-type-classification and columns for alarm-priority-classification.

FIG. 1 illustrates a diagram of a system 100 to facilitate interaction with multidimensional information for an energy system in accordance with aspects of the disclosed subject matter. System 100 can include multidimensional information (MDI) graphical user interface (GUI) component (MDIGUIC) 130. MDIGUIC 130 can facilitate displaying tokens representing subsets of the energy system information according to a MDI interface scheme. The MDI interface scheme organization of tokens can be based on determined classifications for received energy system information. In some embodiments, MDIGUIC 130 can include a classifier, not illustrated, for classifying energy system information. MDIGUIC 130 can receive energy system information 102. Energy system information 102 can include information from constituent parts of an energy distribution or transmission system, such as, but not limited to, electrical transmission system elements, oil pipeline and distribution system elements, or natural gas distribution system elements, etc. As an example, an electrical transmission system element can be a transmission line, a transformer, a generator, a bus, etc. In an aspect, energy system information 102 can include alerts or alarms related to the elements comprising the energy system. As an example, energy system information 102 can include an alarm related to an over pressure condition in a segment of gas pipeline. As a further example, energy system information 102 can include an alarm related to a voltage drop at a transformer element of an electrical transmission system.

MDIGUIC 130 can be communicatively coupled to display component 140. Display component 140 can display a GUI for interaction with a user, e.g., an operator in an energy system control area, etc. Display component 140 can display MDI. In an embodiment, MDI can include representations of energy system information organized by a plurality of classifications. As an example, MDI for an energy system can comprise a set of tokens representing subsets of energy system information organized by a first classification and second classification, such as by energy system element type, alert priority level, primacy/recency, distance/proximity, etc. It will be noted that nearly any relevant metric can be employed in classification of energy system information and that all such classifications can be employed as dimensions for the display of, and interaction with, MDI displayed in a GUI for interaction with users of that information. As an example, display component 140 can display MDI organized by element type and alert priority level, see area 510 of FIG. 5, etc.

In an embodiment, MDIGUIC 130 can include a classifier component, not illustrated, that can classify received energy system information 102. Classification of received energy system information 102 can facilitate rendering MDI on display component 140. Classification can include analysis of received energy system information 102 to determine or infer a classification or a classification value. As an example, where energy system information 102 is related to a gas distribution system, a rapid change in line pressure for a 4" line can be inferred to be a lower priority than a rapid pressure drop in a 16" gas line. As a further example, where energy system information 102 is related to an electrical transmission system, element type classification can be determined from identifiers embedded in received sensor information, e.g., voltage level information from a transmission line sensor can be identified by a sensor identifier that is associated with a transmission line element type class. Of note, any techniques for classifying energy system information is within the scope of the instant disclosure where it can facilitate display of MDI by way of a GUI, however further explicit description of such classification techniques is not done for the sake of clarity and brevity.

The display of MDI can be augmented by facilitating access to more detailed information relating to the subset of energy system information represented by a token in MDI displayed in a GUI. In an embodiment, MDI can be presented in a first portion of display component 140 and selection of a MDI token can result in the display of more detailed information relating to the token in a second portion of display component 140.

In some embodiments, the MDI tokens can include 'count' information. Count information can be a numerical counter of indicating the number of subgroups of energy system information 102 that are classified in a particular classification. As an example, where alerts are classified by element type and priority level, there can be several electrical elements that are of a first element type and of a first priority level, wherein the token for the first element type an first priority level can include count information to convey to a user the number of energy system information subgroups are both of the first element type and the first priority level.

In an embodiment, the MDI tokens can comprise an augment element. An augment element can visually convey additional information related to the corresponding token. As an example, an augment element can be a flashing token, a highlighted token, a token with a heavy border, a token with a broken or dashed border, a token with a colored border, etc. The augment element can convey nearly any type of additional information related to the subgroup of energy system information associated with the token. As an example, an augment element can convey that an alert is recent (as opposed to stale information), that an alert is not yet acknowledged, that a token has transitioned a threshold count value, etc.

In an aspect, MDI can be correlated to alternative energy system information displays. As an example, a histogram of energy system events can be presented in a GUI on display component 140 (see, for example, 570 of FIG. 5, etc.). Of note, nearly any alternative information display can be employed in correlation with MDI and all such alternative information displays are within the instant scope of this disclosure. These additional information displays can provide information to augment the MDI. As an example, in a histogram of energy system events, the number of events at a particular time can be efficiently displayed allowing a user to draw parallels to displayed MDI tokens. In this example, a rapid increase in the number of events at a particular time in a histogram can be quickly correlated to a high count value of specific classifications of energy system information, such as high counts for specific types of equipment and priority levels. In some embodiments, additional information can be accessed from alternative energy system information displays by predetermined interaction techniques. As an example, mousing over a histogram can trigger display of more detailed information, such as in a callout window, etc.

Figure 2:
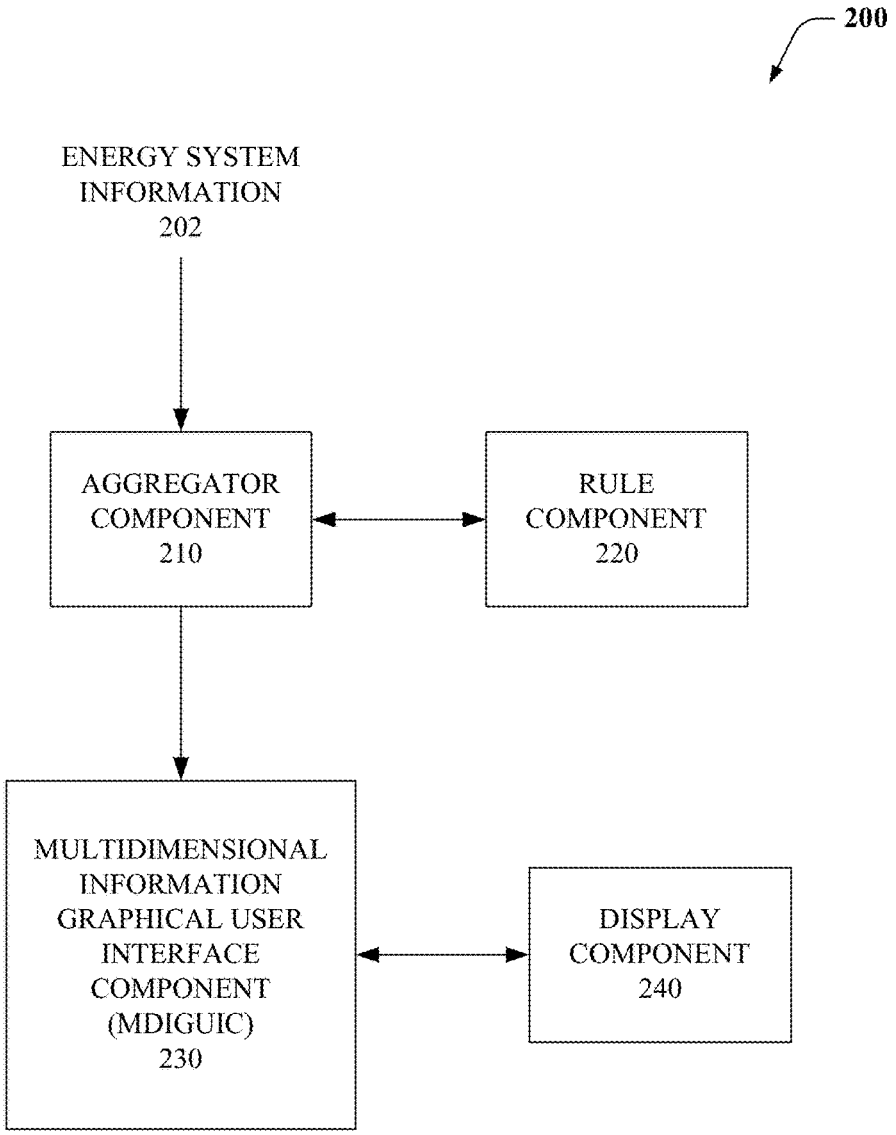
FIG. 2 depicts a system to facilitate interaction with multidimensional information for an energy system in accordance with aspects of the disclosed subject matter.

FIG. 2 depicts a system 200 to facilitate interaction with multidimensional information for an energy system in accordance with aspects of the disclosed subject matter. System 200 can comprise aggregator component 210. Aggregator component 210 can receive energy system information 202. Energy system information 202 can include information from constituent parts of an energy distribution or transmission system. In an aspect, energy system information 202 can include alerts or alarms related to the elements comprising the energy system. In some embodiments aggregator component 210 can aggregate energy system information to serve as a centralized energy system collection node. As such, energy system information can be more centrally managed in contrast to some conventional techniques of locally managing energy system information within subareas of a larger energy system. As an example, aggregator component 210 can receive electrical transmission information for the Western United States region rather than local energy system information management in each of California, Washington, Idaho and Oregon.

Aggregator component 210 can be communicatively coupled to rule component 220. Rule component 220 can facilitate the application of rules to the management of received energy system information 202. In an aspect, rules can facilitate the efficient handling and management of energy system information. In an example, where a first element failure is associated with a predetermined shutdown procedure, a rule can suppress energy system alert information for the energy system elements involved in the predetermined shutdown. As a result, the exemplary rule can allow highly relevant alerts, e.g., for the first element failure, while reducing the clutter from numerous other lesser alerts that can be expected as a result of the predetermined shutdown process. It will be noted that nearly any rule can be applied by way of rule component 220 and all such rules and their application to the received energy system information is within the scope of the present disclosure. In some embodiments, rule component 220 can include a rule store and/or a rule engine.

Aggregator component 210 can also be communicatively coupled to MDIGUIC 230. MDIGUIC 230 can facilitate displaying tokens representing subsets of the energy system information according to a MDI interface scheme. The MDI interface scheme organization of tokens can be based on determined classifications for received energy system information. In some embodiments, MDIGUIC 230 can include a classifier, not illustrated, for classifying energy system information. As an example, subsets of energy system information 202 can be classified and can then be associated with tokens based on their classification. These tokens can then be rendered as multidimensional information in a portion of a GUI on a display according to a MDI interface scheme. A user/operator can visually gather information based on the tokens presented according to the MDI Interface scheme. In some embodiments, the user can interact with the tokens to enable access to more detail information, effect system functionality, etc.

MDIGUIC 230 can be communicatively coupled to display component 240. Display component 240 can display a GUI for interaction with a user. Display component 240 can display MDI. In an embodiment, MDI can include representations of energy system information organized by a plurality of classifications. As an example, MDI for an energy system can comprise a set of tokens representing subsets of energy system information organized by a first classification and second classification.

The display of MDI can be augmented by facilitating access to more detailed information relating to the subset of energy system information represented by a token in MDI displayed in a GUI. In an embodiment, MDI can be presented in a first portion of display component 240 and selection of a MDI token can result in the display of more detailed information relating to the token in a second portion of display component 240.

In some embodiments, the MDI tokens can include 'count' information. Count information can be a numerical counter of indicating the number of subgroups of energy system information 202 that are classified in a particular classification.

In an embodiment, the MDI tokens can comprise an augment element. An augment element can visually convey additional information related to the corresponding token. The augment element can convey nearly any type of additional information related to the subgroup of energy system information associated with the token.

In an aspect, MDI can be correlated to alternative energy system information displays. Of note, nearly any alternative information display can be employed in correlation with MDI and all such alternative information displays are within the instant scope of this disclosure. These additional information displays can provide information to augment the MDI. In some embodiments, additional information can be accessed from alternative energy system information displays by predetermined interaction techniques, e.g., mousing over a histogram can trigger display of more detailed information.

Figure 3:
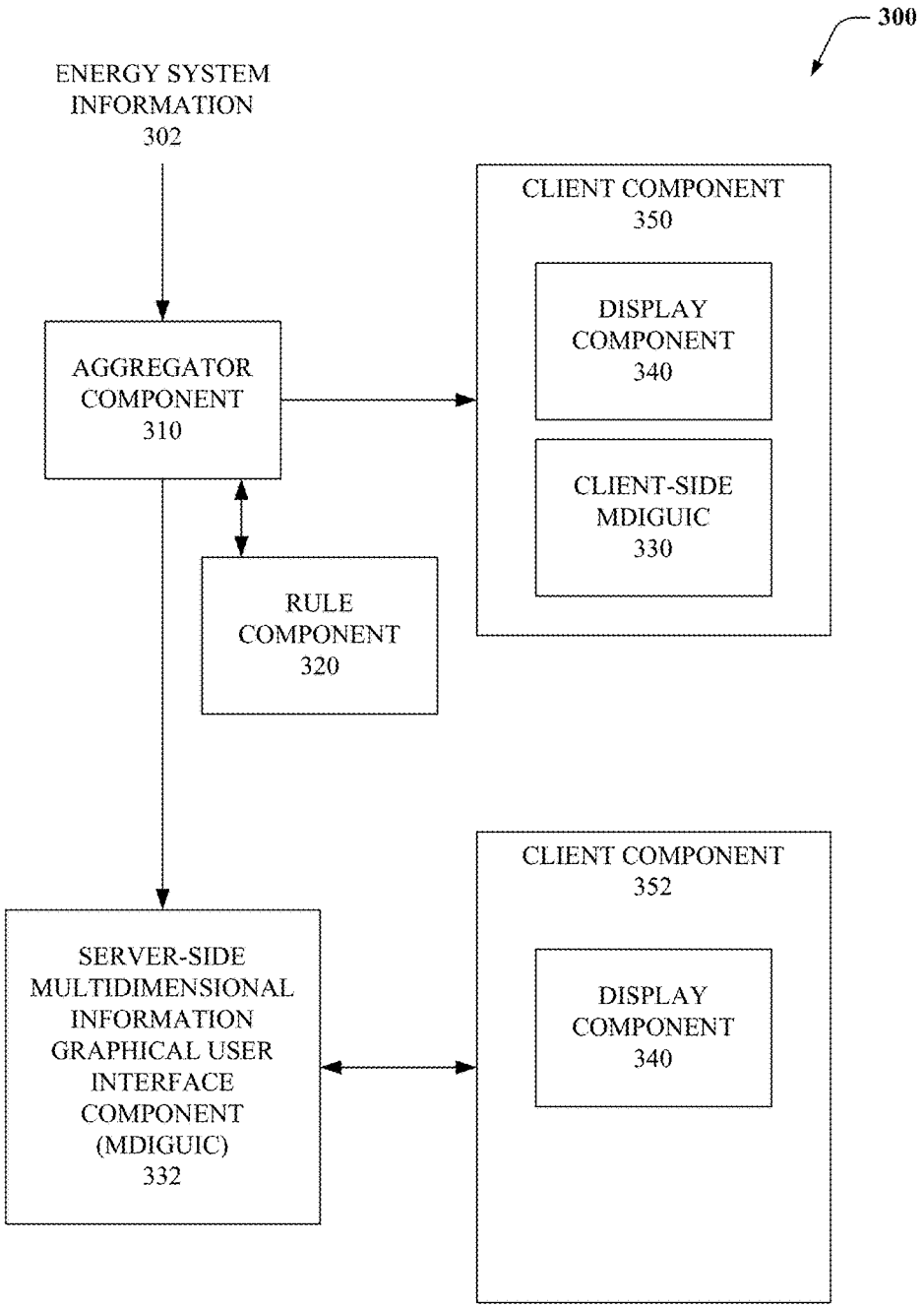
FIG. 3 illustrates a system to facilitate interaction with multidimensional information for an energy system in accordance with aspects of the disclosed subject matter.

FIG. 3 illustrates a system 300 to facilitate interaction with multidimensional information for an energy system in accordance with aspects of the disclosed subject matter. System 300 can include aggregator component 310. Aggregator component 310 can receive energy system information 302. Energy system information 302 can include information from constituent parts of an energy distribution or transmission system. In an aspect, energy system information 302 can include alerts or alarms related to the elements comprising the energy system. Aggregator component 310 can be communicatively coupled to rule component 320. Rule component 320 can facilitate the application of rules to the management of received energy system information 302. In an aspect, rules can facilitate the efficient handling and management of energy system information. It will be noted that nearly any rule can be applied by way of rule component 320 and all such rules and their application to the received energy system information is within the scope of the present disclosure. In some embodiments, rule component 320 can include a rule store and/or a rule engine.

Aggregator component 310 can also be communicatively coupled to server-side MDIGUIC 332. Server-side MDIGUIC 332 can facilitate displaying tokens representing subsets of the energy system information according to a MDI interface scheme. The MDI interface scheme organization of tokens can be based on determined classifications for received energy system information. In some embodiments, server-side MDIGUIC 332 can include a classifier, not illustrated, for classifying energy system information. Subsets of energy system information 302 can be classified and can then be associated with tokens based on their classification. These tokens can then be rendered as multidimensional information in a portion of a GUI on a display according to a MDI interface scheme. A user/operator can visually gather information based on the tokens presented according to the MDI Interface scheme. In some embodiments, the user can interact with the tokens to enable access to more detail information, effect system functionality, etc.

System 300 illustrates that server-side MDIGUIC 332 can be communicatively coupled to a client component 352 that can include display component 340. Client competent 352 can be remote with respect to server-side components, e.g., server-side MDIGUIC 332. Display component 340 can display a GUI for interaction with a user. Display component 340 can display MDI. In an embodiment, MDI can include representations of energy system information organized by a plurality of classifications. As an example, MDI for an energy system can comprise a set of tokens representing subsets of energy system information organized by a first classification and second classification.

System 300 further illustrates that aggregator component 310 can be communicatively coupled to client component 350. Client component 350 can be remote from aggregator component 310. Client component 350 can include client-side MDIGUIC 330 and display component 340. Client-side MDIGUIC 330 can facilitate displaying tokens representing subsets of the energy system information according to a MDI interface scheme. The MDI interface scheme organization of tokens can be based on determined classifications for received energy system information. In some embodiments, client-side MDIGUIC 330 can include a classifier for classifying energy system information. Subsets of energy system information 302 can be classified and can then be associated with tokens based on their classification. These tokens can then be rendered as multidimensional information in a portion of a GUI on a display according to a MDI interface scheme. A user/operator can visually gather information based on the tokens presented according to the MDI Interface scheme. In some embodiments, the user can interact with the tokens to enable access to more detail information, effect system functionality, etc. Display component 340 can display a GUI for interaction with a user. Display component 340 can display MDI. In an embodiment, MDI can include representations of energy system information organized by a plurality of classifications. As an example, MDI for an energy system can comprise a set of tokens representing subsets of energy system information organized by a first classification and second classification.

The display of MDI can be augmented by facilitating access to more detailed information relating to the subset of energy system information represented by a token in MDI displayed in a GUI. In an embodiment, MDI can be presented in a first portion of display component 340 and selection of a MDI token can result in the display of more detailed information relating to the token in a second portion of display component 340.

In some embodiments, the MDI tokens can include 'count' information. Count information can be a numerical counter of indicating the number of subgroups of energy system information 302 that are classified in a particular classification.

In an embodiment, the MDI tokens can comprise an augment element. An augment element can visually convey additional information related to the corresponding token. The augment element can convey nearly any type of additional information related to the subgroup of energy system information associated with the token.

In an aspect, MDI can be correlated to alternative energy system information displays. Of note, nearly any alternative information display can be employed in correlation with MDI and all such alternative information displays are within the instant scope of this disclosure. These additional information displays can provide information to augment the MDI. In some embodiments, additional information can be accessed from alternative energy system information displays by predetermined interaction techniques, e.g., mousing over a histogram can trigger display of more detailed information.

Figure 4:
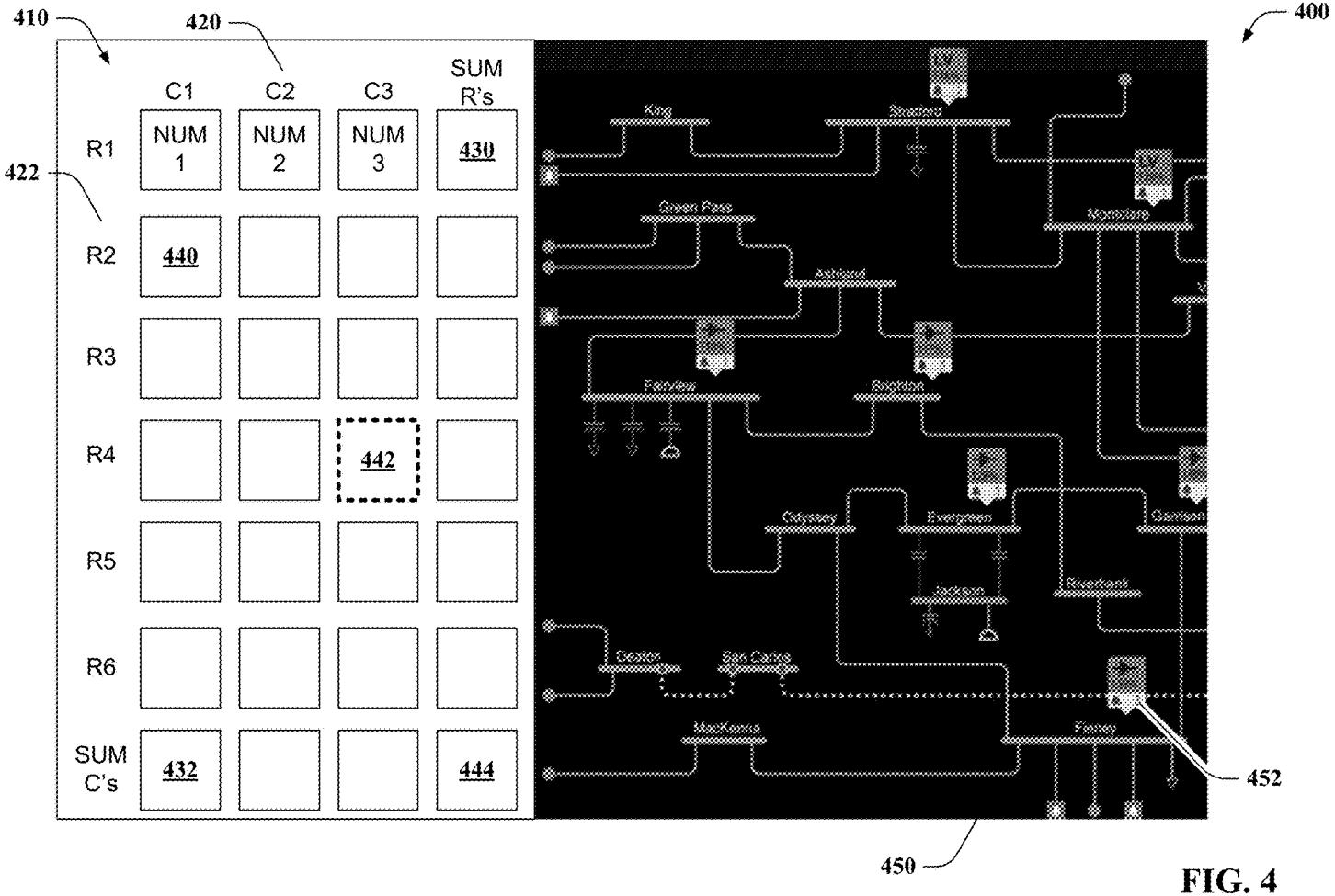
FIG. 4 illustrates a block diagram of an exemplary display of multidimensional information for an energy system in accordance with aspects of the disclosed subject matter.

FIG. 4 illustrates a block diagram 400 of an exemplary display of multidimensional information for an energy system in accordance with aspects of the disclosed subject matter. Diagram 400 generally illustrates a MDI interface 410. MDI interface 410 can be part of a GUI. MDI interface 410 can comprise a plurality of tokens, e.g., 430, 440, 442, 432, 444, etc., organized in accordance with a MDI interface scheme. The MDI interface scheme organization of tokens can be based on determined classifications for received energy system information.

MDI interface 410 can comprise columns 420 and rows 422, wherein a column can represent a first classification and a row can represent a second classification. As an example, columns C1, C2 and C3 can respectively represent a high priority, medium priority, and low priority alert classification of energy system information. Similarly, by example, rows R1-R6 can represent six energy system element types, such as, for an electrical transmission system, busses, transformers, transmission lines, generators, etc. As displayed in the exemplary MDI interface 410, the tokens, e.g., 430, 440, 442, 432, 444, etc., each correspond to both a row, a type classification, and a column, a priority classification.

MDI interface 410 can include 'count' information. Count information can be a numerical counter indicating a number of subgroups of energy system information that are classified in particular classifications. It will be appreciated that more than one subset of energy system information can be associated with the same row and column classification. As an example, where three subsets of energy system information are classified as R1 and C1, then NUM1 can be 3. Similarly, as a second example, where 25 subsets of energy system information are classified as R1 and C3, then NUM3 can be 25. These count values can allow users to quickly determine levels of classifiers in a column dimension, a row dimension or both a column and row dimension. As an example, where NUM1 is 3, NUM2 is 5, and NUM3 is 25, it can quickly be determined that there are 33 R1 energy system information subgroups, e.g., where R1 is a transmission line classification, then there would be 33 transmission line related subsets of energy information. Continuing the example, it can also be quickly determined that there are 25 C3 energy system information subgroups, e.g., where C3 is a low level alert classification, then there would be 25 low level alerts. Still further in this example, there are 5 R1-C2 energy system information subgroups, e.g., where C2 is a medium alert classification, then there would be 5 medium alert transmission line related subsets of energy information.

MDI interface 410 can include, in some embodiments, sum tokens. Sum tokens can sum count information across rows and/or columns. As an example, token 430 can be a sum token for R1, such that where NUM1 is 3, NUM2 is 5, and NUM3 is 25, then 430 can be 33. Similarly, token 432 can sum C1 and where NUM1 is 3, token 432 can be 3. Moreover, sum tokens can also be summed in a sum token, e.g., token 444. Where NUM1 is 3, NUM2 is 5, and NUM3 is 25, then 444 can be 33 (the sum of NUM1 to NUM3 can cause 430 to be 33, which can be summed down to 444, and similarly, NUM1 to NUM3 can be summed down the columns to the SUM C's row and then summed across the SUM C's row to 444).

In some embodiments MDI interface 410 can include an augment element. An augment element can visually convey additional information related to a corresponding token. The augment element can convey nearly any type of additional information related to the subgroup of energy system information associated with the token. Token 442 of MDI interface 410 can include an augment element, e.g., the heavy dashed border of token 442 to convey additional information as disclosed herein.

MDI interface 410 can be augmented by facilitating access to more detailed information, e.g., 450, relating to the subset of energy system information represented by a token in MDI interface 410. In an embodiment, MDI can be presented in a first portion of a display component and selection of a MDI token, e.g., by mouse or touchscreen selection, can result in the display of more detailed information relating to the token in a second portion of the display component. In an aspect, the tokens of MDI interface 410 can function as virtual buttons, such that selection of the token causes a predetermined response. This predetermined response can include populating a detailed information portion of a display, 450, based on the energy system information associated with the selected tokens. As such, selection of more tokens can result in more detail populating the augmentation area 450 while selection of fewer tokens can result in more sparse population of the augmentation area 450. Further, the augmentation area 450 can include nearly any type of supplementary information and can include single-line schematics, maps, textual records, etc. The exemplary supplementary information in augmentation area 450 can be a single-line schematic associated with selected tokens from MDI interface 410. Specific tokens from MDI interface 410 can be correlated to elements of the augmentation area 450, e.g., token 442 can correlate to element 452 such that selection of token 442 can be associated with displaying element 452 in the augmentation area 450. It will be noted that where tokens are associated with more than one element, e.g., counts higher than one, then selection of these tokens can be associated with several elements in the augmentation area 450.

As an example, selection of a toke, e.g., token 442, etc., can populate augmentation area 450 with supplementary information, such as a single-line diagram (SLD). Further, the SLD that can populate augmentation area 450, in response to selection of token 442 in MDI interface 410, can be of zoomed to a scale and oriented in a manner so as to facilitate rapid visual acquisition of the relevant portion of the SLD associated with the token. This can be useful where token 442 is selected in response to a particular state, e.g., an alarm, warning, etc., such as a high current load on a conductor, in that the SLD can be 'focused' on the alerting area in a meaningful way. As illustrated, the area of the SLD illustrated in augmentation area 450 can represent only a small portion of a much larger SLD that, if displayed in augmentation area 450 without zooming and orienting, would be relatively meaningless or challenging to locate the alert in. By zooming and orienting to the corresponding portion of the SLD, selection tokens in MDI interface 410 can improve the operator performance. Further, specific areas within the augmentation area 450 can also receive augmentation, e.g., flashing, highlighting, coloring, etc., that can draw the operator's eye to the relevant portion of the displayed zoomed and oriented information such as the exemplary SLD.

In some embodiments, MDI interface 410 can comprise a fly in/out effect. As such, MDI interface 410 can consume minimal screen area until selected for fly out. In fly out, MDI interface 410 can have a larger footprint to facilitate interaction with the multidimensional information. MDI interface 410 can then undergo a fly in effect (e.g., MDI interface 410 can be 'docked') to again minimize the screen area consumed by MDI interface 410. This can allow the augmentation area 450 to be much larger when the MDI interface 410 is docked.

In an aspect, selection of tokens of MDI interface 410 can be associated with indicators. These indicators can include visual indicators such as colors, shading, three-dimensional (3-D) effects, temporal visual effects, e.g., fading, flashing, etc., size changes, patterns, etc. It will be noted that nearly any visual indicator can be employed to indicate selection of tokens and that all such visual indicators are within the present scope despite not being enumerated for the sake of clarity and brevity. Selection indicators can be in addition to augmentation elements disclosed elsewhere herein.

Moreover, in some embodiments, additional information can be accessed by predetermined interaction techniques. As an example, mousing over an element of the augmentation areas 450, for example element 452, can trigger display of more detailed information, such as in a callout window, etc. (not illustrated). This interaction-triggered access to additional information can be particularly useful where MDI interface 410 allows rapid selection of energy system information subsets of interest based on classification and user selection. Selected tokens can result in population of the augmentation area 450 with corresponding detailed information, and then a user interaction with the displayed detailed information can provide still further information on the element. As an example, clicking on element 452 can cause additional information on element 452 to be displayed (not illustrated).

Figure 5:
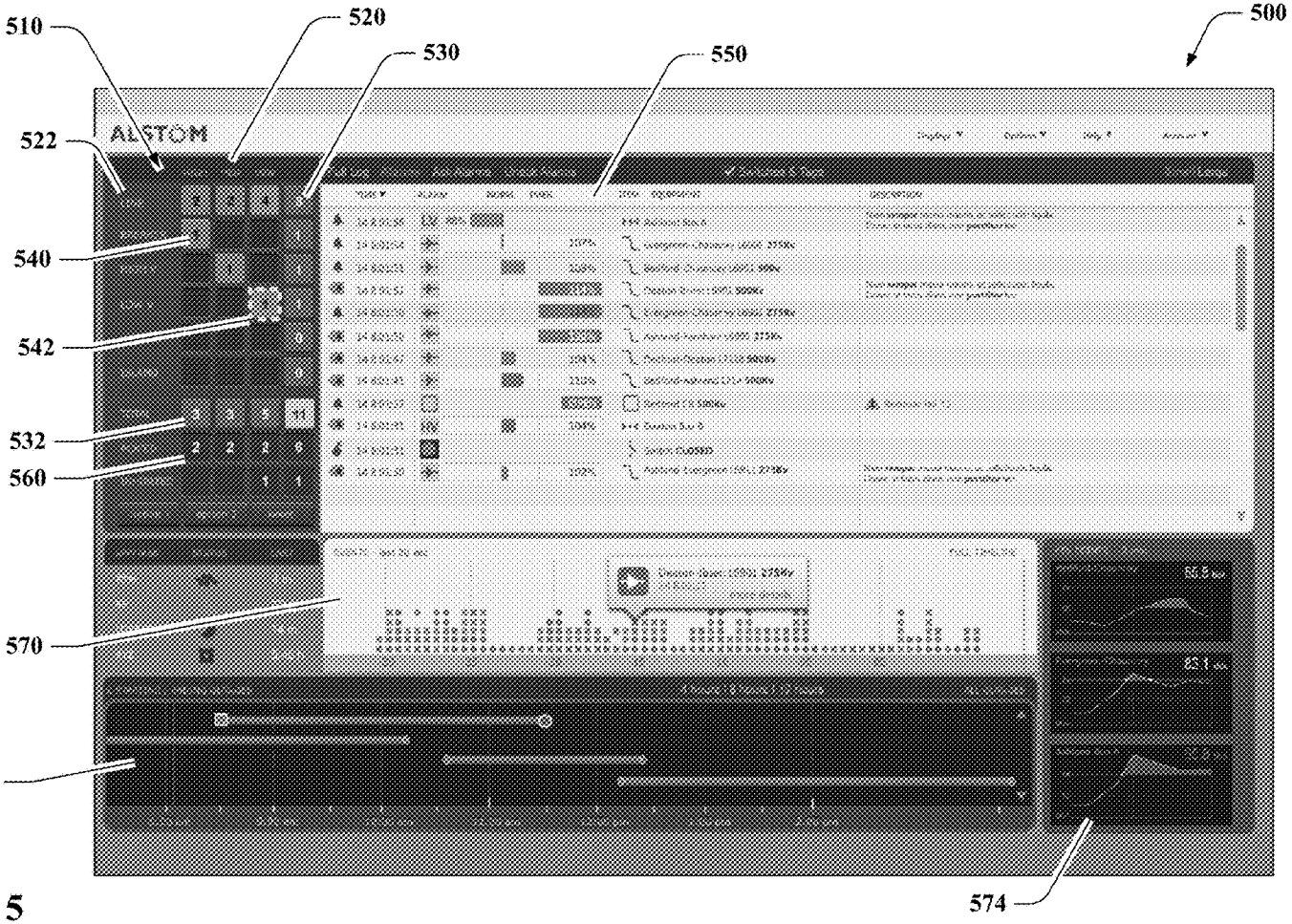
FIG. 5 is a graphic illustration of an exemplary graphical user interface to facilitate interaction with multidimensional information for an energy system in accordance with aspects of the disclosed subject matter.

FIG. 5 is a graphic illustration 500 showing an exemplary graphical user interface to facilitate interaction with multidimensional information for an energy system in accordance with aspects of the disclosed subject matter. Illustration 500 can depict a MDI interface 510. MDI interface 510 can be part of a GUI. MDI interface 510 can comprise a plurality of tokens, e.g., 530, 540, 542, 532, 560, etc., organized in accordance with a MDI interface scheme. The MDI interface scheme organization of tokens can be based on determined classifications for received energy system information.

MDI interface 510 can comprise columns 520 and rows 522, wherein a column can represent a first classification and a row can represent a second classification. As an example, columns HIGH, MED and LOW can respectively represent a high priority, medium priority, and low priority alert classification of energy system information. Similarly, by example, rows LINE, BREAKER . . . ISLAND can represent six energy system element types, such as, for an electrical transmission lines, breakers, etc. As displayed in the exemplary MDI interface 510, the tokens, e.g., 530, 540, 542, 532, 544, etc., can each correspond to both a row, a type classification, and a column, a priority classification.

MDI interface 510 can include 'count' information. Count information can be a numerical counter indicating a number of subgroups of energy system information that are classified in particular classifications. It will be appreciated that more than one subset of energy system information can be associated with the same row and column classification. As an example, where two subsets of energy system information are classified as LINE and HIGH, then token 540 can have a count of 2 as illustrated in 500. These count values can allow users to quickly determine levels of classifiers in a column dimension, a row dimension or both a column and row dimension.

MDI interface 510 can include, in some embodiments, sum tokens. Sum tokens can sum count information across rows and/or columns. As an example, token 530 can be a sum token for the LINE row, such that where HIGH is 2, MED is 2, and LOW is 4, then 530 can be 8 as illustrated in 500. Similarly, token 532 can sum the HIGH column, where LINE is 2 and BREAKER is 1, token 532 can be 3.

In some embodiments MDI interface 510 can include an augment element. An augment element can visually convey additional information related to a corresponding token. The augment element can convey nearly any type of additional information related to the subgroup of energy system information associated with the token. Token 542 of MDI interface 510 can include an augment element, e.g., the heavy dashed border of token 542 to convey additional information as disclosed herein.

MDI interface 510 can further facilitating access to more detailed information, e.g., 550, relating to the subset of energy system information represented by a token in MDI interface 510. In an embodiment, MDI can be presented in a first portion of a display component and selection of a MDI token, e.g., by mouse or touchscreen selection, can result in the display of more detailed information relating to the token in a second portion of the display component. In an aspect, the tokens of MDI interface 510 can function as virtual buttons, such that selection of the token causes a predetermined response. This predetermined response can include populating a detailed information portion of a display, 550, based on the energy system information associated with the selected tokens. As such, selection of more tokens can result in more detail populating the augmentation area 550 while selection of fewer tokens can result in more sparse population of the augmentation area 550. Further, the augmentation area 550 can include nearly any type of supplementary information and can include single-line schematics, maps, textual records, etc. The exemplary supplementary information in augmentation area 550 can be a textual records, including icons, associated with selected tokens from MDI interface 510.

In an aspect, selection of tokens of MDI interface 510 can be associated with indicators. These indicators can include visual indicators such as colors, shading, three-dimensional (3-D) effects, temporal visual effects, e.g., fading, flashing, etc., size changes, patterns, etc. It will be noted that nearly any visual indicator can be employed to indicate selection of tokens and that all such visual indicators are within the present scope despite not being enumerated for the sake of clarity and brevity. Selection indicators can be in addition to augmentation elements disclosed elsewhere herein.

In an embodiment, MDI interface 510 can further include supplementary tokens, e.g., token 560, that can display information relative to elements of MDI interface 510. As an example, token 560 displays a count of acknowledged events in the HIGH column of MDI interface 510, e.g., that 2 of the HIGH classified events have been acknowledged (i.e., "ACK'ED"). Similarly, other information can be displayed, for example, inhibited event counts, etc. Other types of information can be displayed in supplementary tokens without departing from the scope of the instant disclosure.

In a further aspect, MDI interface 510 can be correlated to alternative energy system information displays, e.g., 570, 572, and 574. As an example, a histogram, e.g., 570, of energy system events can be presented. Of note, nearly any alternative information display can be employed in correlation with MDI and all such alternative information displays are within the instant scope of this disclosure. These additional information displays can provide information to augment the MDI. As an example, in the histogram 570 of energy system events, the number of events at a particular time can be efficiently displayed allowing a user to draw parallels to displayed MDI tokens.

Furthermore, the alternative energy system information displays, e.g., 570, 572, and 574, can also be interactive displays. This can include allowing selection or manipulation of information tools presented therein. As an example, where a histogram is presented, such as in alternative energy system information display 570, an operator can select segments of the histogram to gather additional information, such as by way of the illustrated flyout (not numbered). As another example, operator interaction with information in augmentation area 550 can dynamically adjust then information displayed in other areas of the display, such as selection of equipment in augmentation area 550 can populate a work order visualization, e.g., information display 572, with work order information relating to the selected equipment. As a further example, selection of an event in augmentation area 550 can populate a trend visualization area, e.g., information display 574, with information relating to the selected event.

Figure 6:
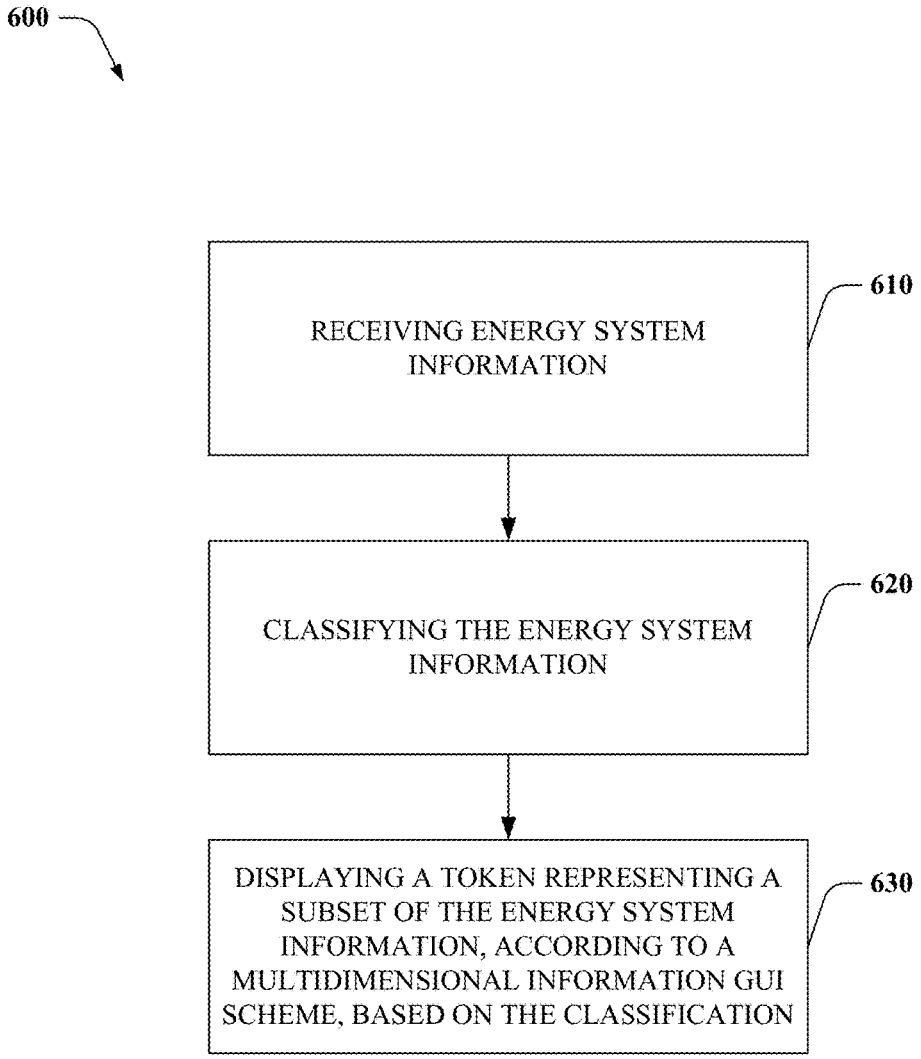
FIG. 6 illustrates a flowchart of procedures for a method facilitating interaction with multidimensional information for an energy system in accordance with aspects of the disclosed subject matter.
Figure 7:
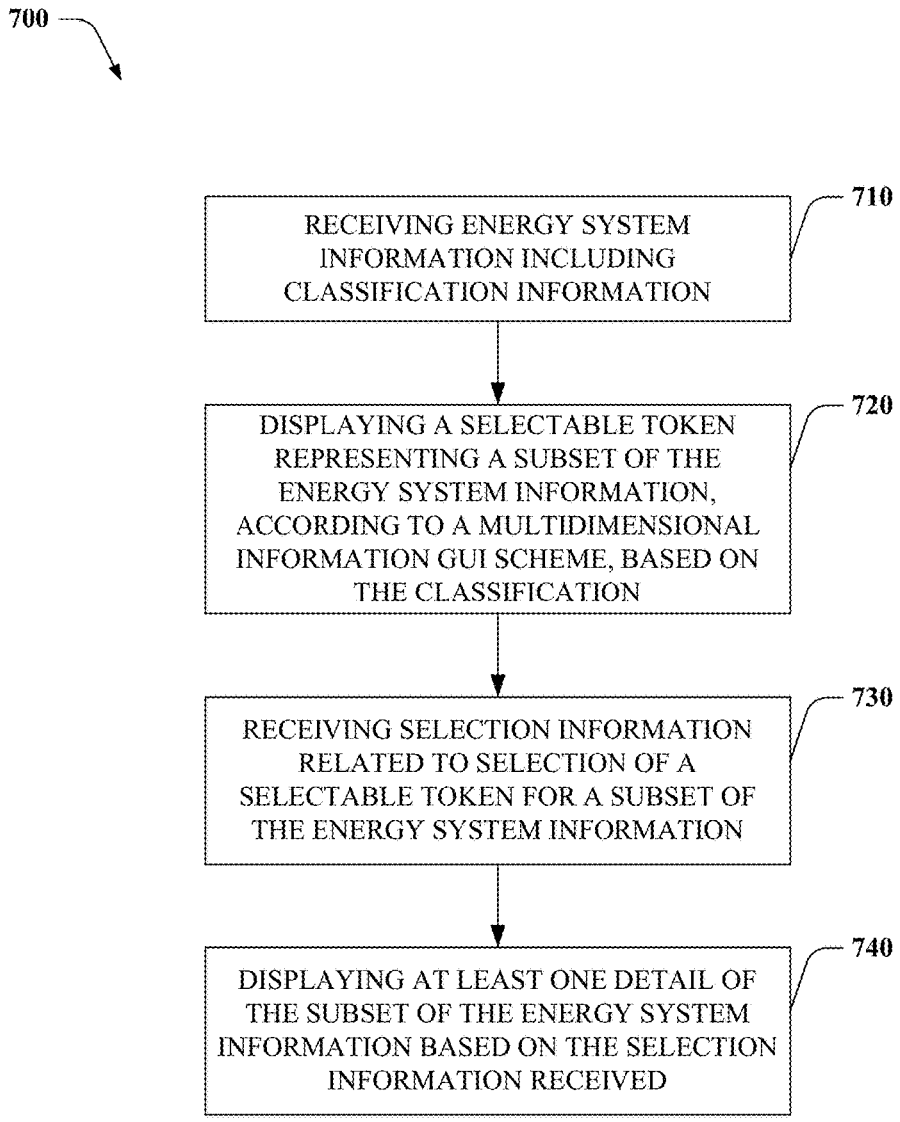
FIG. 7 depicts a flowchart of procedures for a method facilitating interaction with multidimensional information for an energy system in accordance with aspects of the disclosed subject matter.
Figure 8:
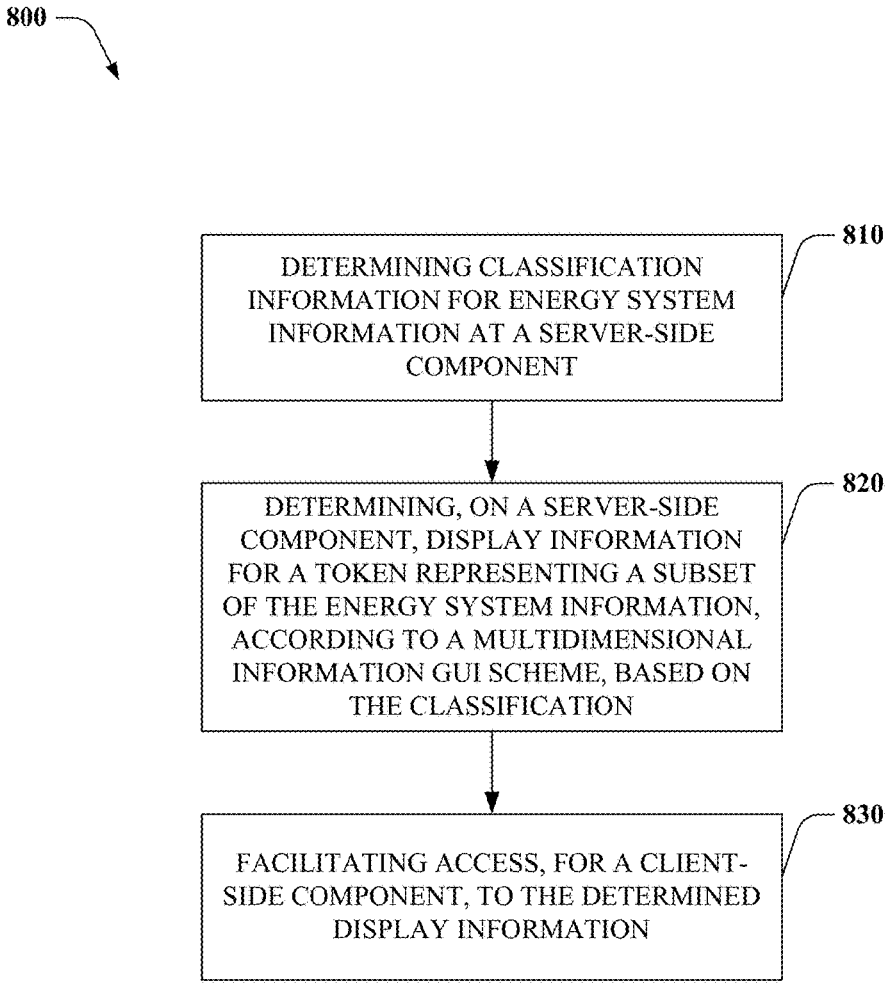
FIG. 8 depicts a flowchart of procedures of a method facilitating server-client based interaction with multidimensional information for an energy system in accordance with aspects of the disclosed subject matter.

In view of the example system(s) described above, example method(s) that can be implemented in accordance with the disclosed subject matter can be better appreciated with reference to flowcharts in FIG. 6 to FIG. 8. For purposes of simplicity of explanation, example methods disclosed herein are presented and described as a series of acts; however, it is to be understood and appreciated that the claimed subject matter is not limited by the order of acts, as some acts may occur in different orders and/or concurrently with other acts from that shown and described herein. For example, one or more example methods disclosed herein could alternatively be represented as a series of interrelated states or events, such as in a state diagram. Moreover, interaction diagram(s) may represent methods in accordance with the disclosed subject matter when disparate entities enact disparate portions of the methodologies. Furthermore, not all illustrated acts may be required to implement a described example method in accordance with the subject specification. Further yet, two or more of the disclosed example methods can be implemented in combination with each other, to accomplish one or more features or advantages herein described. It should be further appreciated that the example methods disclosed throughout the subject specification are capable of being stored on an article of manufacture to allow transporting and transferring such methods to computers for execution, and thus implementation, by a processor or for storage in a memory.

FIG. 6 illustrates a flowchart of procedures for a method 600 facilitating interaction with multidimensional information for an energy system in accordance with aspects of the disclosed subject matter. At 610, method 600 can receive energy system information. Energy system information can include information from constituent parts of an energy distribution or transmission system, such as, but not limited to, electrical transmission system elements, oil pipeline and distribution system elements, or natural gas distribution system elements, etc. As an example, an electrical transmission system element can be a transmission line, a transformer, a generator, a bus, etc. In an aspect, energy system information can include alerts or alarms related to the elements comprising the energy system. As an example, energy system information can include an alarm related to a flow rate in a segment of oil pipeline. As a further example, energy system information can include an alarm related to a phase offset between conductor elements of an electrical transmission system.

At 620, the energy system information can be classified. Classification of received energy system information can facilitate rendering multidimensional information (MDI). Classification can include analysis of received energy system information to determine or infer a classification or a classification value. As an example, where energy system information is related to an oil pipeline system, a temperature change of 1 degree can be determined to be a lower priority than a temperature change of 10 degrees. As a further example, where energy system information is related to an electrical transmission system, drifting output voltages in a solar electrical generation station output can be inferred to be a low priority based on known cloud cover conditions in the region.

At 630, a token representing a subset of the energy system information can be displayed in accordance with a MDI interface scheme. The token display, or rendering, can be based on the classification of corresponding subsets of the energy system information from 620. At this point method 600 can end. In an aspect, the token can be displayed on a display component such as a computer monitor, a tablet computer display, a smartphone display, etc. In an embodiment, MDI can include representations of energy system information organized by a plurality of classifications. As an example, MDI for an energy system can comprise a set of tokens representing subsets of energy system information organized by a first classification and second classification.

The display of MDI can be augmented by facilitating access to more detailed information relating to the subset of energy system information represented by a token in MDI displayed in a GUI. In an embodiment, MDI can be presented in a first portion of a display component and selection of a MDI token can result in the display of more detailed information relating to the token in a second portion of the display component. In some embodiments, the MDI tokens can include 'count' information. Count information can be a numerical counter of indicating the number of subgroups of energy system information that are classified in a particular classification. In an embodiment, the MDI tokens can comprise an augment element. An augment element can visually convey additional information related to the corresponding token. In an aspect, MDI can be correlated to alternative energy system information displays. Nearly any alternative information display can be employed in correlation with MDI and all such alternative information displays are within the instant scope of this disclosure. In some embodiments, additional information can be accessed from alternative energy system information displays by predetermined interaction techniques. As an example, mousing over a histogram can trigger display of more detailed information, such as in a callout window, etc.

FIG. 7 depicts a flowchart of procedures for a method 700 facilitating interaction with multidimensional information for an energy system in accordance with aspects of the disclosed subject matter. At 710, energy system information, including classification information, can be received. At 720, a token representing a subset of the energy system information can be displayed in accordance with a MDI interface scheme. The token display, or rendering, can be based on the classification of a corresponding subset of energy information from the energy system information received at 710.

At 730, selection information related to selection of a selectable token for a subset of the energy system information can be received. In an aspect, the selection information can be related to user/operator interaction with MDI tokens of a MDI GUI. At 740, at least one detail of the subset of the energy system information can be displayed based on the selection information received at 730. At this point method 700 can end.

In an embodiment, MDI can be presented in a first portion of a display component and selection of a MDI token, e.g., by mouse, touchscreen selection, etc., can result in the display of more detailed information relating to the token in a second portion of the display component. In an aspect, the tokens of a MDI GUI can function as virtual buttons, such that selection of the token can be related to a predetermined response. This predetermined response can include populating a detailed information portion of a display based on the energy system information associated with the selected tokens. As such, selection of more tokens can result in more detail populating the augmentation area while selection of fewer tokens can result in more sparse population of the augmentation area. In an aspect, the detailed information can be included in nearly any type of supplementary information and this can include single-line schematics, maps, textual records, etc. In a further aspect, selection of tokens of a MDI interface can be associated with indicators. These indicators can include visual indicators such as colors, shading, 3-D effects, temporal visual effects, e.g., fading, flashing, etc., size changes, patterns, etc. Selection indicators can be in addition to augmentation elements disclosed elsewhere herein.

FIG. 8 depicts a flowchart of procedures of a method 800 facilitating server-client based interaction with multidimensional information for an energy system in accordance with aspects of the disclosed subject matter. At 810, classification information for energy system information can be determined at a server-side component. At 820, display information for a token can be determined on a server-side component. The display information can be for a token representing a subset of the energy system information and can accord with a MDI interface scheme. The display information can be based on the classification determined at 810. In an aspect, the display information can be rendering information for rendering tokens on a display component.

At 830, access to the determined display information can be facilitated for a client-side component. At this point method 800 can end. In an aspect, method 800 discloses a server-client method wherein the classification and MDI interface display instructions are determined on a server and can be accessed by a client for displaying to a user/operator. In some embodiments, this can be termed as a thin client server method.

Figure 9:
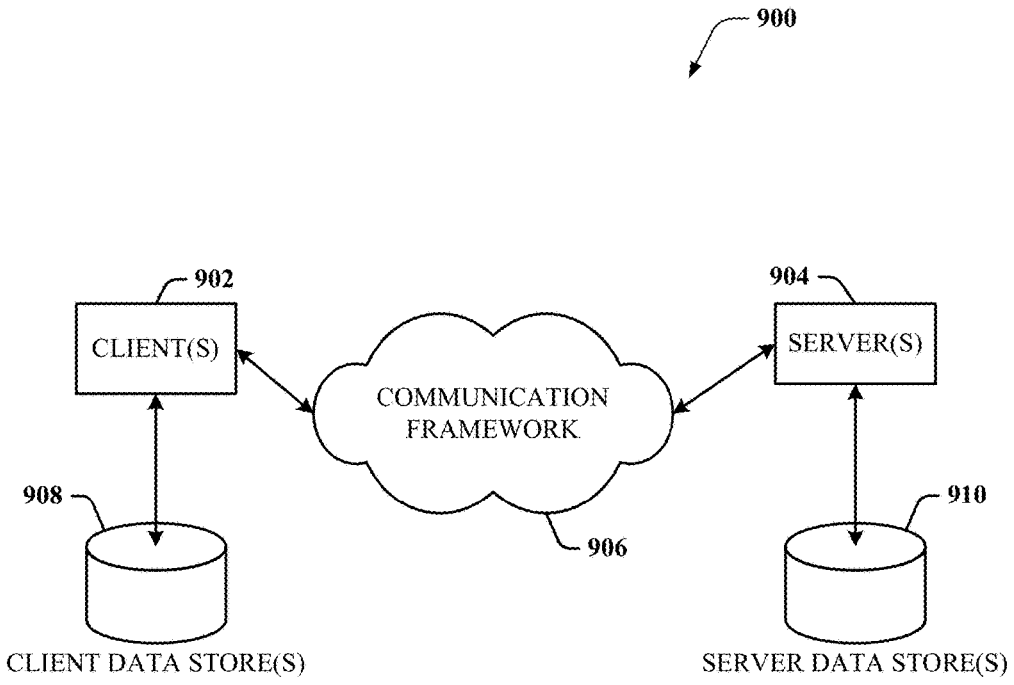
FIG. 9 illustrates a schematic block diagram of an exemplary computing environment facilitating interaction with multidimensional information for an energy system in accordance with another aspect.

FIG. 9 illustrates a schematic block diagram 900 of an exemplary computing environment for state estimation to facilitate interaction with multidimensional information for an energy system in accordance with another aspect. The system 900 includes one or more client(s) 902. The client(s) 902 can be hardware and/or software (e.g., threads, processes, computing devices). The client(s) 902 can include, for example, client component 350 or 352, as disclosed herein.

The system 900 also includes one or more server(s) 904. The server(s) 904 can also be hardware and/or software (e.g., threads, processes, computing devices). One possible communication between a client 902 and a server 904 can be in the form of a data packet adapted to be transmitted between two or more computer processes. The data packet can include, for example, energy system information or MDI rendering instructions information in accord with system 300. The system 900 includes a communication framework 906 (e.g., a global communication network such as the Internet) that can be employed to facilitate communications between the client(s) 902 and the server(s) 904.

Communications can be facilitated via a wired (including optical fiber) and/or wireless technology. The client(s) 902 can be operatively connected to one or more client data store(s) 908 that can be employed to store information local to the client(s) 902. Similarly, the server(s) 904 can be operatively connected to one or more server data store(s) 910 that can be employed to store information local to the servers 904. In an aspect, there can be a plurality of clients 902, e.g., a plurality of MDI GUIs. As an example, in system 300, a plurality of clients are illustrated, e.g., client components 350 and 352.

Figure 10:
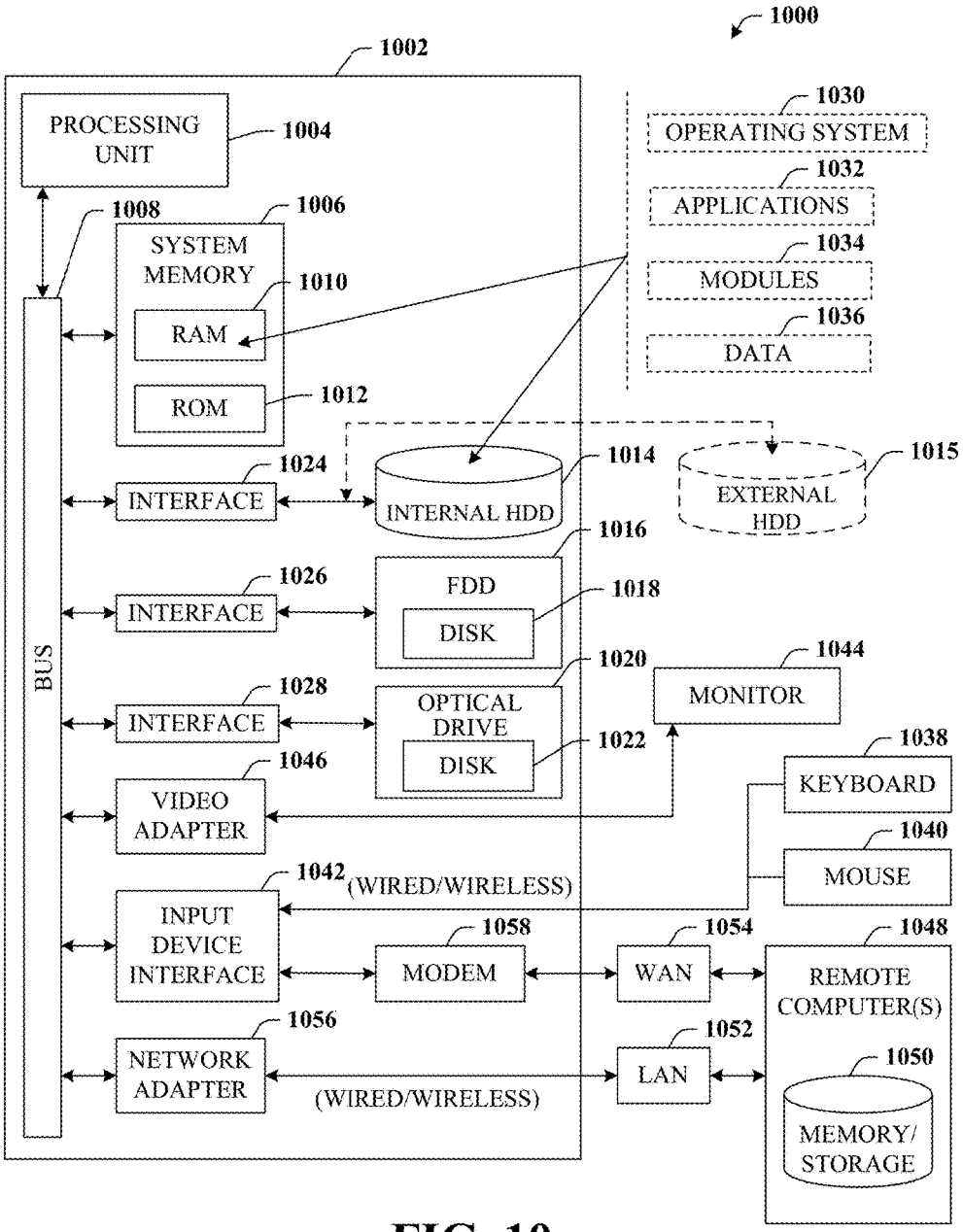
FIG. 10 illustrates a block diagram of a computer operable to execute a portion of the disclosed subject matter.

Referring now to FIG. 10, there is illustrated a block diagram of an exemplary computer system operable to execute the disclosed subject matter. In order to provide additional context for various aspects of the disclosed subject matter, FIG. 10 and the following discussion are intended to provide a brief, general description of a suitable computing environment 1000 in which the various aspects of the disclosed subject matter can be implemented. Additionally, while the disclosed subject matter described above may be suitable for application in the general context of computer-executable instructions that may run on one or more computers, those skilled in the art will recognize that the disclosed subject matter also can be implemented in combination with other program modules and/or as a combination of hardware and software.

Generally, program modules include routines, programs, components, data structures, etc., that perform particular tasks or implement particular abstract data types. Moreover, those skilled in the art will appreciate that the disclosed methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the disclosed subject matter can also be practiced in distributed computing environments where certain tasks are performed by remote processing devices that are linked through a communications network. In a distributed computing environment, program modules can be located in both local and remote memory storage devices. As non-limiting examples, MDI interface information, e.g., by way of server-side MDIGUIC 332, etc., can be accessible by way of the World Wide Web (Web), on corporate servers, on the dedicated communications pathway component(s), etc.

Computing devices typically include a variety of media, which can include computer-readable storage media and/or communications media, which two terms are used herein differently from one another as follows. Computer-readable storage media can be any available storage media that can be accessed by the computer and includes both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and include any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 10, the exemplary environment 1000 for implementing various aspects of the disclosed subject matter includes a computer 1002, the computer 1002 including a processing unit 1004, a system memory 1006 and a system bus 1008. System bus 1008 couples to system components including, but not limited to, the system memory 1006 to the processing unit 1004. The processing unit 1004 can be any of various commercially available processors. Dual microprocessors and other multi-processor architectures may also be employed as the processing unit 1004.

System bus 1008 can be any of several types of bus structure that may further interconnect to a memory bus (with or without a memory controller), a peripheral bus, and a local bus using any of a variety of commercially available bus architectures. The system memory 1006 includes read-only memory (ROM) 1010 and random access memory (RAM) 1012. A basic input/output system (BIOS) is stored in a non-volatile memory 1010 such as ROM, EPROM, EEPROM, which BIOS contains the basic routines that help to transfer information between elements within the computer 1002, such as during start-up. The RAM 1012 can also include a high-speed RAM such as static RAM for caching data.

The computer 1002 further includes an internal hard disk drive (HDD) 1014, e.g., EIDE, SATA, which internal hard disk drive 1014 may also be configured for external use in a suitable chassis, e.g., 1015, a magnetic floppy disk drive (FDD) 1016, e.g., to read from or write to a removable diskette 1018, and an optical disk drive 1020, e.g., reading a CD-ROM disk 1022 or, to read from or write to other high capacity optical media such as the DVD. The hard disk drive 1014 (or 1015), magnetic disk drive 1016 and optical disk drive 1020 can be connected to the system bus 1008 by a hard disk drive interface 1024, a magnetic disk drive interface 1026 and an optical drive interface 1028, respectively. The interface 1024 for external drive implementations includes at least one or both of Universal Serial Bus (USB) and IEEE1394 interface technologies. Other external drive connection technologies are within contemplation of the subject matter disclosed herein.

The drives and their associated computer-readable media provide nonvolatile storage of data, data structures, computer-executable instructions, and so forth. For the computer 1002, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods of the disclosed subject matter.

A number of program modules can be stored in the drives and RAM 1012, including an operating system 1030, one or more application programs 1032, other program modules 1034 and program data 1036. All or portions of the operating system, applications, modules, and/or data can also be cached in the RAM 1012. It is appreciated that the disclosed subject matter can be implemented with various commercially available operating systems or combinations of operating systems.

A user can enter commands and information into the computer 1002 through one or more wired/wireless input devices, e.g., a keyboard 1038 and a pointing device, such as a mouse 1040. Other input devices (not shown) may include a microphone, an IR remote control, a joystick, a game pad, a stylus pen, touch screen, or the like. These and other input devices are often connected to the processing unit 1004 through an input device interface 1042 that is coupled to the system bus 1008, but can be connected by other interfaces, such as a parallel port, an IEEE1394 serial port, a game port, a USB port, an IR interface, etc.

A monitor 1044 or other type of display device, e.g., display component 140, 240, 340, etc., is also connected to the system bus 1008 via an interface, such as a video adapter 1046. In addition to the monitor 1044, a computer typically includes other peripheral output devices (not shown), such as speakers, printers, etc.

The computer 1002 may operate in a networked environment using logical connections via wired and/or wireless communications to one or more remote computers, such as a remote computer(s) 1048. For example, server-side MDI-GUIC 332, can be remote from client component 352. As a second example, cellular type communications can be employed, e.g., as a wireless communications modality disclosed hereinabove. The remote computer(s) 1048 can be a workstation, a server computer, a router, a personal computer, a mobile device, portable computer, microprocessor-based entertainment appliance, a peer device or other common network node, and typically includes many or all of the elements described relative to the computer 1002, although, for purposes of brevity, only a memory/storage device 1050 is illustrated. The logical connections depicted include wired/wireless connectivity to a local area network (LAN) 1052 and/or larger networks, e.g., a wide area network (WAN) 1054. Such LAN and WAN networking environments are commonplace in offices and companies, and facilitate enterprise-wide computer networks, such as intranets, all of which may connect to a global communications network, e.g., the Internet.

When used in a LAN networking environment, the computer 1002 is connected to the local network 1052 through a wired and/or wireless communication network interface or adapter 1056. The adapter 1056 may facilitate wired or wireless communication to the LAN 1052, which may also include a wireless access point disposed thereon for communicating with the wireless adapter 1056.

When used in a WAN networking environment, the computer 1002 can include a modem 1058, or is connected to a communications server on the WAN 1054, or has other means for establishing communications over the WAN 1054, such as by way of the Internet. The modem 1058, which can be internal or external and a wired or wireless device, is connected to the system bus 1008 via the serial port interface 1042. In a networked environment, program modules depicted relative to the computer 1002, or portions thereof, can be stored in the remote memory/storage device 1050. It will be appreciated that the network connections shown are exemplary and other means of establishing a communications link between the computers can be used.

The computer 1002 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag, e.g., a kiosk, news stand, restroom, etc., and telephone. This includes at least Wi-Fi and Bluetooth™ wireless technologies. Thus, the communication can be a predefined structure as with a conventional network or simply an ad hoc communication between at least two devices.

As used herein, the term "communicatively" coupled or similar terms indicates that the coupling can at least support communication between components while the term "energetically" connected or similar terms indicates that the connection can at least support energy transfer between components. As such, an energetic connection is not strictly limited to energy transfer, unless otherwise indicated. An energetic connection can therefore also have a communicative aspect. As a non-limiting example, electrical energy can be transferred from a distribution transformer to a smart meter by way of mains conductors and information can be carried over the same mains conductors, e.g., power line communication.

As used in this application, the terms "component," "system," "platform," "layer," "selector," "interface," and the like are intended to refer to a computer-related entity or an entity related to an operational apparatus with one or more specific functionalities, wherein the entity can be either hardware, a combination of hardware and software, software, or software in execution. As an example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers. Also, these components can execute from various computer readable media having various data structures stored thereon. The components may communicate via local and/or remote processes such as in accordance with a signal having one or more data packets, e.g., data from one component interacting with another component in a local system, distributed system, and/or across a network such as the Internet with other systems via the signal. As another example, a component can be an apparatus with specific functionality provided by mechanical parts operated by electric or electronic circuitry, which is operated by a software or firmware application executed by a processor, wherein the processor can be internal or external to the apparatus and executes at least a part of the software or firmware application. As yet another example, a component can be an apparatus that provides specific functionality through electronic components without mechanical parts, the electronic components can include a processor therein to execute software or firmware that confers at least in part the functionality of the electronic components.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Furthermore, the terms "user," "subscriber," "customer," "consumer," "prosumer," "agent," and the like are employed interchangeably throughout the subject specification, unless context warrants particular distinction(s) among the terms. It should be appreciated that such terms can refer to human entities or automated components supported through artificial intelligence, e.g., a capacity to make inference based on complex mathematical formalisms, which can provide simulated vision, sound recognition and so forth.

As used herein, the terms "infer" or "inference" generally refer to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE802.11(a, b, g, n, etc.) to provide secure, reliable, fast wireless connectivity. A Wi-Fi network can be used to connect computers to each other, to the Internet, and to wired networks (which use IEEE802.3 or Ethernet). Wi-Fi networks operate in the unlicensed 2.4 and 5 GHz radio bands, at an 11 Mbps (802.11b) or 54 Mbps (802.11a) data rate, for example, or with products that contain both bands (dual band), so the networks can provide real-world performance similar to the basic "10BaseT" wired Ethernet networks used in many offices.

Various aspects or features described herein can be implemented as a method, apparatus, or article of manufacture using standard programming and/or engineering techniques. In addition, various aspects disclosed in the subject specification can also be implemented through program modules stored in a memory and executed by a processor, or other combination of hardware and software, or hardware and firmware. The term "article of manufacture" as used herein is intended to encompass a computer program accessible from any computer-readable device, carrier, or media. For example, computer readable media can include but are not limited to magnetic storage devices, e.g., hard disk, floppy disk, magnetic strips, etc., optical disks, e.g., compact disc (CD), digital versatile disc (DVD), blu-ray disc (BD), etc., smart cards, and flash memory devices, e.g., card, stick, key drive, etc. Additionally it should be appreciated that a carrier wave can be employed to carry computer-readable electronic data such as those used in transmitting and receiving electronic mail or in accessing a network such as the internet or a local area network (LAN). Of course, those skilled in the art will recognize many modifications may be made to this configuration without departing from the scope or spirit of the disclosed subject matter.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor also can be implemented as a combination of computing processing units.

In the subject specification, terms such as "store," "data store," "data storage," "database," "repository," and substantially any other information storage component relevant to operation and functionality of a component, refer to "memory components," or entities embodied in a "memory" or components comprising the memory. It will be appreciated that the memory components described herein can be either volatile memory or nonvolatile memory, or can include both volatile and nonvolatile memory. In addition, memory components or memory elements can be removable or stationary. Moreover, memory can be internal or external to a device or component, or removable or stationary. Memory can include various types of media that are readable by a computer, such as hard-disc drives, zip drives, magnetic cassettes, flash memory cards or other types of memory cards, cartridges, or the like.

By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

What has been described above includes examples of the various embodiments. It is, of course, not possible to describe every conceivable combination of components or methodologies for purposes of describing the embodiments, but one of ordinary skill in the art may recognize that many further combinations and permutations are possible. Accordingly, the detailed description is intended to embrace all such alterations, modifications, and variations that fall within the spirit and scope of the appended claims.

In particular and in regard to the various functions performed by the above described components, devices, circuits, systems and the like, the terms (including a reference to a "means") used to describe such components are intended to correspond, unless otherwise indicated, to any component which performs the specified function of the described component, e.g., a functional equivalent, even though not structurally equivalent to the disclosed structure, which performs the function in the herein illustrated exemplary aspects of the embodiments. In this regard, it will also be recognized that the embodiments includes a system as well as a computer-readable medium having computer-executable instructions for performing the acts and/or events of the various methods.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

What is claimed is:

1. A system comprising:

a memory that stores computer-executable instructions; and a processor, communicatively coupled to the memory, that facilitates execution of the computer-executable instructions to at least:

receive energy system information comprising data associated with operational control of an energy system;

display, via a graphical user interface of an energy system control device, the data, wherein the display of the data comprises the display of a graphic image other than text, wherein the data is representative of a subset of the energy system information according to multiple dimensions, wherein a first dimension of the multiple dimensions represents a first classification of at least one energy system element represented by the subset of the energy system information, and a second dimension of the multiple dimensions represents a second classification of the at least one energy system element different than the first classification, and wherein the graphic image is indicative of a characteristic of the subset of the energy system information satisfying a rule related to an alert level of displayed information; and in response to receiving an input related to the data displayed via the graphical user interface, initiate a change in the operation of the energy system.

2. The system of claim 1, wherein the energy system information is electrical transmission system information.

3. The system of claim 1, wherein the energy system information is oil or gas distribution system information.

4. The system of claim 1, wherein the energy system information includes alert or alarm information regarding an alert or alarm associated with the at least one energy system element represented by the subset of the energy system information.

5. The system of claim 1, wherein the processor further facilitates execution of the computer-executable instructions to classify the energy system information and wherein the display of the data is based on at least two classifications of the subset of the energy system information represented by the data.

6. The system of claim 5, wherein a classification of the at least two classifications is a type classification associated with the at least one energy system element represented by the subset of the energy system information.

7. The system of claim 5, wherein a classification of the at least two classifications is an alert classification regarding an alert associated with the at least one energy system element represented by the subset of the energy system information.

8. The system of claim 1, wherein the data is a selectable token.

9. The system of claim 8, wherein the selectable token is displayed with a selection indicator indicative of a selection condition of the selectable token.

10. The system of claim 9, wherein the selection indicator is a color change associated with the selectable token, a shading change associated with the selectable token, a three-dimensional effect associated with the selectable token, a temporally changing visual effect associated with the selectable token, a size change associated with the selectable token, an intensity change associated with the selectable token, or a pattern change associated with the selectable token.

11. The system of claim 8, wherein selection of the selectable token causes the processor to further facilitate execution of computer-executable instructions to display additional information related to the at least one energy system element represented by the subset of the energy system information.

12. The system of claim 1, wherein the multiple dimensions of the data are displayed by way of a multidimensional graphical user interface having a plurality of rows and a plurality of columns.

13. The system of claim 12, wherein the multidimensional graphical user interface includes a fly-in effect and a fly-out effect, wherein, the fly-in effect causes the multidimensional graphical user interface to increase in visible footprint size, and the fly-out effect causes the multidimensional graphical user interface to decrease in visible footprint size.

14. A method, comprising:

receiving, by a system including at least one processor, energy system information enabling visualization of a control structure of an energy system, wherein the energy system information comprises data associated with operational control of the energy system, wherein a first dimension of the data represents a first classification of a first energy system element and a second dimension of the data represents a second classification of a second energy system element different than the first classification;

classifying, by the system, the energy system information according to at least two classifications of energy system elements represented by the energy system information;

facilitating display, by the system via a graphical user interface of an energy system operational control device, of a portion of the data representing at least a subset of the energy system information according to a multidimensional information interface that represents the at least two classifications of the energy system information, wherein the portion of the data comprises at least one iconic representation other than text, and wherein the at least one iconic representation is representative of a characteristic of the subset of the energy system information satisfying a rule related to an alert level of displayed information; and in response to determining a first operational change based on selection information, triggering, by the system, a second operational change in an energy system element of the energy system elements.

15. The method of claim 14, wherein facilitating the display of the portion of the data includes display of a selectable token associated with the portion of the data.

16. The method of claim 15, further comprising:

receiving, by the system, the selection information, wherein the selection information is related to selection of the selectable token; and displaying, by the system, additional information related to the subset of the energy system information represented by the portion of the data associated with the selected selectable token.

17. The method of claim 14, wherein the facilitating display of the portion of the data includes display of the portion of the data according to a multidimensional information interface having a plurality of rows and a plurality of columns.

18. The method of claim 14, wherein facilitating the display of the portion of the data includes display of the portion of the data with a selection indicator indicative of a selection state of a selectable token.

19. A non-transitory computer-readable storage medium having computer-executable instructions stored thereon that, in response to execution, cause a computing device including a processor to perform operations, comprising:

classifying energy system information according to at least two different classifications to facilitate presentation of data comprising the energy system information via a graphical user interface of an energy system operation controller device, wherein the energy system information comprises data associated with operational control of a corresponding energy system, and wherein a first dimension of the data represents a first classification of a first energy system element and a second dimension of the data represents a second classification of a second energy system element different than the first classification;

displaying, via the graphical user interface, the data, wherein the displaying the data comprises displaying a graphic image other than text, wherein the data is representative of a subset of the energy system information in accordance with a multidimensional information interface based on the at least two different classifications of the energy system information, the multidimensional information interface organizing layout of the data according to the at least two different classifications, and wherein the graphic image is indicative of a characteristic of the subset of the energy system information satisfying a rule related to an alert level of displayed information; and initiating an energy system operational change associated with the energy system information based on a determination related to selection of the data via the graphical user interface.

20. The non-transitory computer-readable storage medium of claim 19, wherein the data is a selectable token and the computer-executable instructions cause a computing device to perform further operations, comprising:

receiving selection information related to selection of the selectable token; and displaying additional information related to the subset of the energy system information represented by the selected selectable token.

* * * * *